US010825627B2

(12) United States Patent
Urankar et al.

(10) Patent No.: US 10,825,627 B2
(45) Date of Patent: Nov. 3, 2020

(54) CONTROLLABLE ELECTRIC CURRENT SWITCHGEAR AND ELECTRICAL ASSEMBLY COMPRISING THIS SWITCHGEAR

(71) Applicant: Schneider Electric Industries SAS, Rueil Malmaison (FR)

(72) Inventors: Lionel Urankar, Fontaine (FR); Stephane Follic, Lumbin (FR); Silvio Rizzuto, Grenoble (FR)

(73) Assignee: Schneider Electric Industries SAS, Rueil Malmaison (FR)

( * ) Notice: Subject to any disclaimer, the term of this patent is extended or adjusted under 35 U.S.C. 154(b) by 261 days.

(21) Appl. No.: 16/043,828

(22) Filed: Jul. 24, 2018

(65) Prior Publication Data

US 2019/0035584 A1 Jan. 31, 2019

(30) Foreign Application Priority Data

Jul. 26, 2017 (FR) ..... 17 57100

(51) Int. Cl.
*H01H 47/22* (2006.01)
*H01H 50/54* (2006.01)
(Continued)

(52) U.S. Cl.
CPC ..... *H01H 47/226* (2013.01); *H01H 47/02* (2013.01); *H01H 47/22* (2013.01); *H01H 47/325* (2013.01); *H01H 50/54* (2013.01)

(58) Field of Classification Search
CPC ..... H01H 47/02; H01H 47/22; H01H 47/226; H01H 47/325; H01H 50/54
(Continued)

(56) References Cited

U.S. PATENT DOCUMENTS 4,456,871 A * 6/1984 Stich ..... H02M 7/1555 323/217
5,452,172 A * 9/1995 Lane ..... H01F 7/1615 361/71

(Continued)

FOREIGN PATENT DOCUMENTS

EP 3 041 102 A1 7/2016
FR 2 977 401 A1 1/2013

OTHER PUBLICATIONS

French Preliminary Search Report dated Apr. 13, 2018 in French Application 17 57100, filed on Jul. 26, 2017 (with English Translation of Categories of cited documents and Written Opinion).

*Primary Examiner* — Kevin J Comber
(74) *Attorney, Agent, or Firm* — Oblon, McClelland, Maier & Neustadt, L.L.P.

(57) ABSTRACT

A controllable electric current switchgear includes a bistable relay including separable electrical contacts and an excitation coil for switching the contacts between open and closed states when the coil receives an amount of energy that is higher than a predefined excitation energy threshold with an electrical power that is higher than a predefined power threshold; and a control circuit including a power stage and a logic stage for triggering the switching of the relay. The power stage includes a power converter, a first set of capacitors connected at the input of the converter and a second set of capacitors connected at the output of the converter, the nominal power of the converter being strictly lower than the power threshold, the sets of capacitors being capable of storing an amount of energy that is higher than or equal to 50% of the excitation energy threshold.

11 Claims, 5 Drawing Sheets

(51) Int. Cl.
*H01H 47/32* (2006.01)
*H01H 47/02* (2006.01)

(58) Field of Classification Search
USPC ..... 361/152
See application file for complete search history.

(56) References Cited

U.S. PATENT DOCUMENTS

2008/0048624 A1* 2/2008 Davison ..... H02H 7/0822
320/166
2010/0097733 A1* 4/2010 E ..... H02H 1/0015
361/42

* cited by examiner

CONTROLLABLE ELECTRIC CURRENT SWITCHGEAR AND ELECTRICAL ASSEMBLY COMPRISING THIS SWITCHGEAR

The present invention relates to controllable electric current switchgear. The invention also relates to an electrical assembly comprising this switchgear.

As is known, electric current switchgear exists, such as contactors, able to be controlled remotely in order to selectively interrupt the flow of an electric current within an electric circuit, for example in order to drive the supply of power to an electrical load. Electromechanical remote switches and contactors are known in particular, these being commanded by way of an electrical signal so as to switch between open or closed states. Such electromechanical switchgear has been satisfactory for a long time.

However, new applications are making it increasingly desirable to integrate new functions, called smart functions, into modern switchgear, in particular in terms of driving and remote communication. In particular, industrial and/or domestic installations need to be able to be monitored and controlled remotely, for example for load-shedding or for home automation application management purposes, or else for remote diagnostic purposes.

The addition of such functions involves integrating electronic elements into this switchgear, which entails certain drawbacks.

Firstly, the bulk and the dimensions of this switchgear have to be strictly controlled. It is vital for this switchgear to be of a size that makes it compatible with existing installations. It therefore has to have dimensions that do not exceed those of known switchgear, these dimensions generally being small. This poses a large constraint in terms of integrating and of miniaturizing components of these contactors.

Secondly, the addition of electronic components and of dedicated circuits leads to an increase in electrical consumption in comparison with electromechanical devices. This consumption leads to an excess cost for the user and to heat dissipation that has to be controlled. This heat dissipation is all the more inconvenient on account of the abovementioned miniaturization demands, as the dissipated power, with respect to the small volume of the switchgear, may become high to the point of being detrimental to the correct operation thereof or to the longevity thereof. Electrical consumption therefore needs to be optimized.

It is these drawbacks that the invention intends more particularly to rectify, by proposing controllable electric current switchgear able to be controlled in an improved manner and having optimized energy management and a controlled bulk.

To this end, the invention relates to controllable electric current switchgear, this switchgear being capable of being connected between an electrical load and an electric power source, so as to selectively allow or prevent the supply of electric power to the electrical load by the power source, the switchgear including:

a bistable relay comprising separable electrical contacts and an excitation coil for commanding the switching of the electrical contacts, these electrical contacts being capable of connecting the electrical load to the power source, the relay being capable of switching the electrical contacts between open and closed states when the coil receives an amount of energy that is higher than a predefined excitation energy threshold with an electric power that is higher than a predefined power threshold;

a control circuit comprising a power stage and a logic stage, the power stage being capable of providing a supply of electric power to the logic stage, the logic stage comprising an excitation circuit for supplying power to the coil and a programmable microcontroller that drives the excitation circuit so as to trip the switching of the relay, The power stage comprises a power converter, a first set of capacitors connected at the input of the power converter and a second set of capacitors connected at the output of the power converter, the nominal power of the power converter being strictly lower than the excitation power threshold of the coil, the first and second sets of capacitors being capable of storing an amount of energy that is higher than or equal to 50% of the excitation energy threshold required to switch the relay.

By virtue of the invention, by storing the energy able to be used to excite the coil of the relay in capacitors, a sharp increase in the electrical consumption of the control circuit, at the moment when the switching of the relay is commanded, is avoided. In fact, the electric power that has to be provided to the electrical switchgear is more stable over time. This makes it possible to reduce the heat dissipation of the electrical switchgear and also to simplify the design of the power stage. Furthermore, the use of a power converter whose nominal power is strictly lower than the excitation power of the coil of the relay allows for reduced electrical consumption. Thus, the energy consumption of the electrical switchgear is harnessed, and heat dissipation is reduced.

According to some advantageous but non-mandatory aspects of the invention, such switchgear may incorporate one or more of the following features, either alone or in any technically permissible combination:

The power converter is a flyback converter comprising a voltage transformer, the first set of capacitors being connected to a primary winding of the transformer, the second set of capacitors being connected to a secondary winding of the transformer.

The second set of capacitors is capable of storing at least 50% of the excitation energy necessary for switching the relay.

The capacitors of the first set are made of ceramic and the capacitors of the second set are made of tantalum.

The power stage includes an additional power converter capable of supplying a stabilized DC electric voltage for supplying electric power to at least part of the logic stage.

The microcontroller is programmed to drive the excitation circuit using a pulse width modulation technique, the excitation circuit being capable of supplying the coil with a modulated supply voltage.

The microcontroller is programmed to implement, after having ordered the switching of the relay following the reception of a control order, steps of:

determining a previously received prior switching order, determining a flow state of the electric current to the electrical load by way of the electrical contacts of the relay, this state being able to indicate the absence or the presence of a current, estimating a state of the relay on the basis of predefined rules and depending on the determined current flow state and on the prior switching order.

The microcontroller is programmed to implement, after having ordered the switching of the relay following the reception of a control order, steps of:

measuring the time necessary for the switching of the relay;

comparing the measured time with a known switching time value of the relay, in order to determine whether the measured time is different from the known switching time value;

updating the known switching time value, on the basis of the value of the measured time, only if the measured time is determined as being different from the known switching time value.

The microcontroller is programmed to implement steps of:

identifying the type of the electrical load;

choosing a strategy for synchronizing the switching depending on the identified load type;

following the reception of a switching order, implementing the chosen synchronization strategy, this implementation including measuring at least one electrical variable between power supply terminals of the electrical load in order to detect a switching condition corresponding to the chosen synchronization strategy;

tripping the switching of the relay when a switching condition corresponding to this switching strategy is identified on the basis of the at least one measured electrical variable, the tripping of the switching of the relay being prevented, at least temporarily, as long as a switching condition corresponding to this switching strategy is not identified.

The logic stage comprises a radio communication interface capable of being connected to a radio antenna, said radio antenna being positioned outside a housing of the switchgear and connected to the interface.

According to another aspect, the invention relates to an electrical assembly comprising an electrical load, an electric power source capable of delivering an electric supply voltage, and electric current switchgear, the switchgear being connected between the electrical load and the electric power source and comprising, to this end, a controllable relay whose separable electrical contacts selectively connect the power supply terminals of the electrical load to the source or, alternately, electrically isolate them from the source, the electrical assembly being as described above.

The invention will be better understood and other advantages thereof will become more clearly apparent in the light of the following description of one embodiment of a contactor given solely by way of example and with reference to the appended drawings, in which:

FIG. 1 shows controllable electrical switchgear 1 for switching an electric current, such as a contactor or a remote switch.

Figure 1:
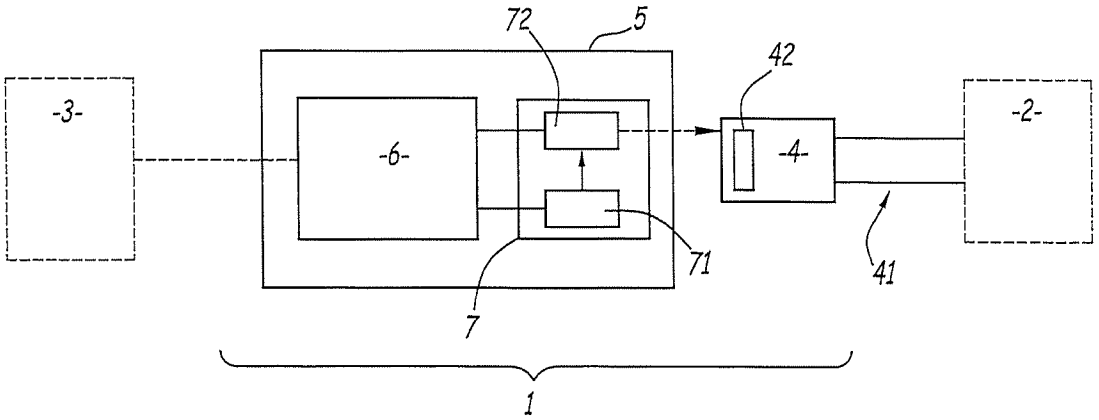
FIG. 1 is a schematic depiction of a contactor according to the invention for driving the supply of power to an electrical load.

The switchgear 1 is connected between an electrical load 2 and an external electric power source 3, for example within a domestic or industrial electrical installation.

The electrical load 2 includes a device or a set of electrical devices intended to be supplied with electric power by way of power supply terminals.

The role of the switchgear 1 is to selectively connect the load 2 to the source 3 in order to allow the flow of an electric current supplying power to the load 2 or, alternately, to isolate the load 2 from the source 3 in order to prevent the supply of power to the load 2.

To this end, the switchgear 1 in this case includes a bistable relay 4 and a control circuit 5 for driving the relay 4.

The relay 4 includes separable electrical contacts 41 for selectively connecting the source 3 to the load 2.

The electrical contacts 41 include fixed parts and mobile parts. For example, first fixed parts of the electrical contacts 41 are connected to the source 3. Second fixed parts of the electrical contacts 41 are connected to the power supply terminals of the load 2. The mobile parts of the electrical contacts 41 are moveable, selectively and reversibly, between a closed state and an open state.

In the closed state, the mobile parts connect the first and second fixed parts to one another. The contacts 41 therefore connect the power supply terminals of the load 2 to the source 3.

In the open state, the mobile parts are separated from the first and second fixed parts, thus isolating them from one another. The contacts 41 therefore isolate the power supply terminals of the electrical load 2 with respect to the source 3, thus preventing an electric supply current from flowing to the electrical load 2.

To simplify FIG. 1, the fixed and mobile parts of the electrical contacts 41 are not illustrated.

In the following text, the terms 'movement of the contacts 41' and 'state of the relay 4' also make reference to the closed or open state of the mobile parts of the electrical contacts 41.

The relay 4 also includes at least one excitation coil 42, capable of exerting a magnetic force so as to switch, or move, the contacts 41 between the open and closed states when this coil 42 is excited by the control circuit 5.

In a known manner, the coil 42 in this case includes an electrically conductive wire wound into one or more turns so as to form a solenoid. The excitation of the coil 42 consists in sending an electric supply current into this conductive wire so as to generate a magnetic flux.

The name 'excitation power' or 'activation power' is given to the minimum electric power that has to be provided to the coil 42, for a duration greater than or equal to a predefined threshold, for the purpose of switching the relay 4. The minimum excitation energy corresponds to the product of the excitation power and the predefined duration threshold. In other words, to switch the relay 4, the coil 42 has to receive an electrical energy that is higher than a predefined excitation energy threshold with an electric power that is higher than a predefined excitation power threshold.

In the following example, the relay 4 includes a single coil 42. However, the operation described is able to be transposed to variants in which the relay 4 includes a plurality of coils 42, each then having to be excited in order to trip the switching. In such a case, the excitation power described hereinafter with reference to the dimensions of the power stage is understood to mean the electric power necessary to excite all of these coils 42.

In this example, to excite the coil 42, it is necessary to provide it with a power higher than or equal to 1 W for a duration greater than or equal to 15 ms. The nominal switching duration of the relay in this case is 10 ms. Other values are possible, however, depending on the relay 4 that is used.

With the relay 4 being a bistable relay, the switching of the relay 4 to one or the other of the open and closed states is performed by exciting the coil 42 identically, for example by providing it with one and the same amount of energy. In other words, once the switching of the relay 4 takes effect, the relay 4 remains, in a stable manner, in the same state until the coil 42 is excited again and receives an amount of energy sufficient to switch to the opposite state.

In the following example, the relay 4 includes a single coil 42. However, the operation described here is able to be transposed to variants in which the relay 4 includes a plurality of coils 42, each then having to be excited in order to trip the switching. In such a case, during the switching, the power stage 6 has to provide the power and the electrical energy necessary to simultaneously excite all of these coils 42.

The control circuit 5 in this case includes a power stage 6 and a logic stage 7.

The role of the stage 6 is to generate a stabilized DC electric voltage from an AC electric supply voltage, in particular in order to supply electric power to the logic stage 7 so as to ensure the correct operation thereof.

The power stage 6 is in this case intended to be connected electrically to the source 3 for the one AC electric supply voltage. As a variant, the power stage 6 may receive a supply voltage from a voltage source separate from the source 3.

The logic stage 7 includes in particular a programmable microcontroller 71 and an excitation circuit 72 for exciting the coil 42 of the relay 4, that is to say, as explained above, for injecting an electric current into the coil 42 so as to provide it with the energy and the power that are required for switching. This electrical energy comes from the power stage 6.

The circuit 72 is, to this end, driven by the microcontroller 71 and supplied with power in a manner regulated by the power stage 6, for example using a pulse width modulation (PWM) technique. This driving by the microcontroller 71 is described in greater detail in the following text.

The switchgear 1 also includes a protective housing, not shown, inside which the relay 4 and the control circuit 5, in particular, are housed. The housing is made from an electrically insulating material. For example, it is a moulded housing made of plastic. The dimensions of the housing are preferably standardized. For example, the housing has a width of less than or equal to 18 mm.

Figure 2:
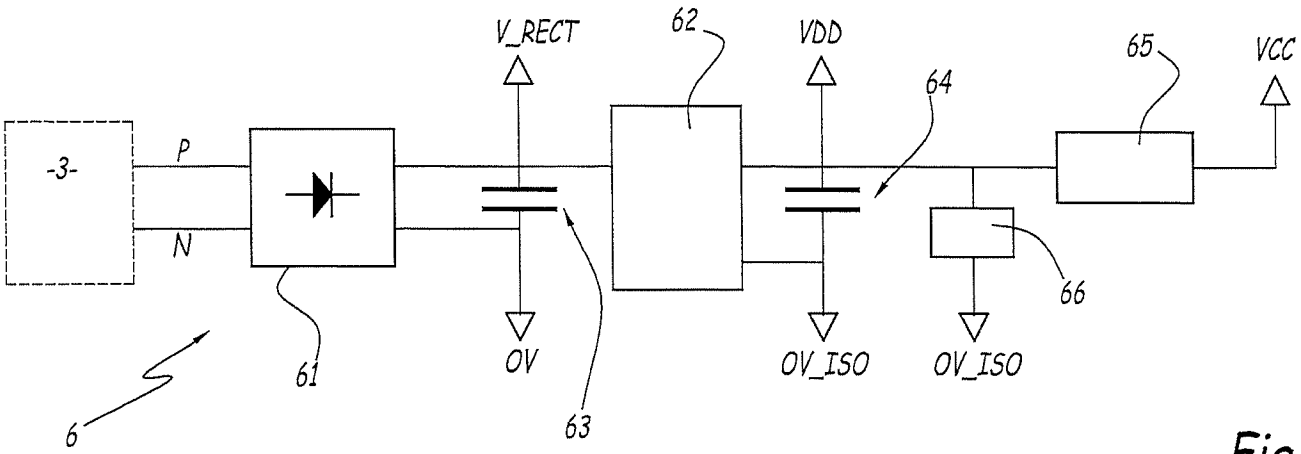
FIG. 2 is a schematic depiction of a power stage of a control circuit of the contactor of FIG. 1.
Figure 3:
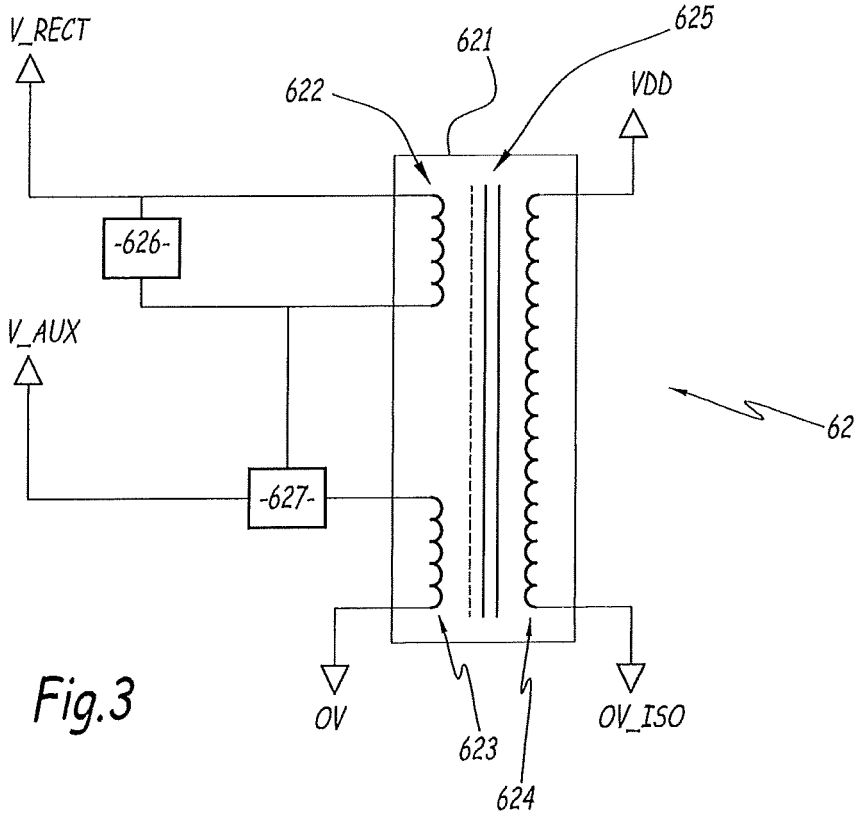
FIG. 3 is a schematic depiction of a power converter of the power stage of FIG. 2.

FIGS. 2 and 3 show an example of the power stage 6 of the switchgear 1 in greater detail.

In this example, the input of the power stage 6 is capable of being connected to the source 3 via input terminals, in this case denoted P and N, for 'phase' and 'neutral' respectively.

The source 3 is able to provide an AC electric supply voltage. Said source is for example an electric generator or an electrical distribution network. For example, the supply voltage has an amplitude of between 85 V AC and 276 V AC and a frequency of between 45 Hz and 65 Hz. The switchgear 1 in this case has a wide input range, making it capable of operating on electrical networks supplied with 110 V AC or with 220 V AC, and on electrical networks operating at 50 Hz or at 60 Hz.

The power stage 6 includes in particular a rectifier 61, a first DC-to-DC power converter 62, a set of input capacitors 63, a set of output capacitors 64, and a second DC-to-DC power converter 65.

The power stage 6 optionally furthermore includes an energy store 66, whose role is described in the following text.

The rectifier 61 is configured to transform the AC supply voltage received at input between the terminals P and N into a first DC voltage, termed rectified voltage, denoted V_RECT. This rectified voltage is in this case delivered at the output of the rectifier 61, between a first electric power supply rail and a first electrical ground '0V' of the stage 6. For example, the rectifier 61 includes a diode bridge.

In the following text, for the sake of simplicity, the power supply rail is denoted using the same reference as the electrical potential to which it is brought. Ground 0V in this case has zero electrical potential. The difference in potential between the power supply rail V_RECT and ground 0V is therefore equal to the electrical potential to which the power supply rail V_RECT is brought.

The converter 62 is in this case configured to transform the rectified voltage V_RECT into a second DC voltage VDD. This rectified voltage is delivered at output between a second electric power supply rail VDD and a second electrical ground '0V_ISO' of the stage 6. This second ground 0V_ISO is in this case galvanically isolated from the first ground 0V by virtue of the converter 62.

For example, the voltage VDD has an amplitude equal to 6 V. However, in practice, the voltage VDD, although it is DC, may fluctuate over time around a mean value.

Galvanic isolation is particularly advantageous in the case where the switchgear 1 is capable of radio communication. In such a case, a radio antenna is used. When the switchgear 1 is installed in an electrical switchboard, the presence of numerous electrical units and of electrical conductors, such as busbars, is a source of interference. Such a radio antenna is generally installed outside the housing of the switchgear 1. In fact, the radio antenna is therefore accessible to a user while at the same time being connected to components inside the housing 1 that are potentially exposed to the supply voltage coming from the source 3. Good electrical isolation is therefore essential in order to avoid causing an electrical risk to users.

Advantageously, the converter 62 is dimensioned so as to have a nominal power that is strictly lower than the excitation power of the coil 42. This nominal power is preferably lower than or equal to 75% of the excitation power of the coil 42. The nominal power in this case corresponds to the electric power that is transmitted at output by the converter 62. It therefore does not include the thermal power dissipated by the converter 62.

In the following text, the name 'operating power' is given to the electric power consumed by the stage 6 when it is operating in the absence of excitation of the coil 42. For example, in practice, it is more precisely a mean power value around which the electric power consumed at each instant by the stage 6 may fluctuate.

This operating power is in this case strictly lower than the power consumed by the stage 6 when the coil 42 is excited.

In this example, the operating power, consumed by the power stage 6 during normal operation thereof in the absence of excitation of the coil, is equal to 0.2 W.

The converter 62 includes a voltage transformer. This makes it possible in particular to provide galvanic isolation between the grounds 0V and 0V_ISO.

The converter 62 is preferably a 'flyback' converter. This furthermore makes it possible to provide a wide input range in terms of amplitude of the input electric voltages.

As illustrated in FIG. 3, the converter 62 in this case includes a transformer 621 that comprises a primary winding 622, an auxiliary winding 623 and a secondary winding 624, which are formed around a magnetic core 625 that is for example made of ferrite.

In this example, the converter 62 furthermore comprises an auxiliary regulation circuit including:

a clipping circuit 626 comprising, for example, one or more transient voltage suppression diodes, termed transil diodes, and/or Zener diodes and/or a circuit comprising a resistor, a diode and a capacitor of 'RCD snubber' type;

a high-frequency commandable switch 627 connected to an auxiliary power supply rail V_AUX at the terminals of the auxiliary winding 623 that supplies power to a circuit for commanding the switch 627, the voltage between the auxiliary power supply rail V_AUX and ground 0V being a DC voltage V_AUX that depends on the voltage V_RECT.

To this end, the group 626 is connected at input to the power supply rail V_RECT and, at output, to a terminal of the first winding 622, on the one hand, and to a voltage rail V_AUX that is supplied with what is termed an auxiliary voltage that is also denoted V_AUX. The opposite terminal of the first winding 622 is connected to the power supply rail V_RECT. The regulator 627 is connected at input to the rail V_AUX and, at output, to the output of the group 626. The auxiliary winding 623 is connected to the rail V_AUX, on the one hand, and to ground 0V, on the other hand. The auxiliary winding 624 is connected to the rail VDD, on the one hand, and to ground 0V_ISO, on the other hand.

As a variant, the converter 62 may be regulated differently.

In this example, the converter 62 is dimensioned in terms of nominal power at least partly by choosing the properties of the magnetic core 625, for example so that the latter only permits a limited power that is lower than the excitation power of the coil 42.

For example, in one preferred embodiment, the transformer 62 is dimensioned so as to transfer, to the output of the converter 62, up to 75% of the excitation power of the coil 42 without magnetically saturating the core 625.

In this example, the converter 62 is configured to continuously provide an output power of 0.2 watts.

Furthermore, the diameter of the conductive wires forming the windings 622, 623 and 624 is chosen to be as small as possible, depending on the operating power of the stage 6 in the absence of excitation of the coil 42. However, the conductive wires do not have an excessively small diameter, so as not to increase the risk of breakage of the wire when manufacturing the windings.

In this example, the diameters are chosen such that the converter 62 continuously provides an output power of 0.2 W, with a current density of 10 A/mm$^2$ in the conductive wires.

By way of non-limiting example, the windings 622 and 623 are in this case formed by winding a conductive copper wire with a diameter of 40 on the AWG 'American Wire Gauge' scale, and the winding 624 is in this case formed by winding a conductive copper wire with a diameter of 36 on the AWG scale.

As a variant, these values may be chosen differently, in particular depending on the features of the coil 42.

The set of capacitors 63 includes one or more capacitors connected electrically in parallel. This set of capacitors 63 is connected at the input of the converter 62, for example between the rail V_RECT and ground 0V. The capacitance of the set 63 is denoted 'Cin' in the following text.

As illustrated in FIG. 2, the set of capacitors 64 includes one or more capacitors connected electrically in parallel. This set of capacitors 63 is connected at the output of the converter 62, for example between the rail VDD and ground 0V. The capacitance of the set 64 is denoted 'Cont' in the following text.

The sets of capacitors 63 and 64 are configured to store, together, at least part of the energy necessary for exciting the coil 42, for example more than 50% of the energy necessary for exciting the coil 42 or, preferably, more than 80% or, even more preferably, more than 90% of the energy necessary for exciting the coil 42.

Furthermore, these sets of capacitors 63 and 64 are capable of discharging so as to supply power to the excitation circuit 72, and therefore the coil 42, when the switching of the relay 4 is commanded, for example when the excitation circuit 72 is activated by the microcontroller 71 and when the AC supply voltage has an amplitude lower than a voltage threshold.

Thus, in this example, when the excitation of the coil 42 is commanded, and when the AC supply voltage is insufficient on its own to excite the coil 42, then the necessary excitation energy comes mainly, or even completely, from the capacitors 63 and 64. By contrast, when the incoming AC supply voltage is at a maximum value, then the power provided by this supply voltage is partly sufficient to excite the coil 42. In such a case, the sets of capacitors 63 and 64 are barely called upon to provide the excitation energy for the coil 42.

Such operation contributes to optimizing the electrical consumption of the switchgear 1.

The capacitances Cin and Cout are therefore chosen depending on the power and on the amount of energy that are required to excite the coil 42 of the relay 4, and therefore to switch the relay 4 between the open and closed positions.

These values are preferably chosen such that the second set 64 is capable of storing more energy than the first set 63 and, preferably, such that the second set 64 stores at least 50% of the necessary excitation energy. In other words, the second set 64 is in this case capable of storing more energy than the first set 63.

In this example, given the excitation energy value of the coil 42 of the relay 4 and values of electric voltages across the terminals of the sets 63 and 64, the value Cin is in this case lower than or equal to 1 μF and the value Gout is lower than or equal to 500 μF.

By way of illustrative example, the set 63 in this case includes four identical capacitors, each with a capacitance of 220 nF. The set 64 in this case includes, connected in parallel, two identical 220 μF capacitors and one 10 μF capacitor.

Advantageously, the capacitors of the set 63 are ceramic technology capacitors. The capacitors of the set 64 are made of tantalum.

Capacitors made of ceramic and of tantalum have a smaller bulk than electrolytic technology capacitors. Their use therefore makes it easier to physically integrate the power stage 6 within the housing of the switchgear 1, since it enables less space to be occupied. Furthermore, they are more reliable than electrolytic capacitors. By avoiding having to resort to electrolytic capacitors for main functions of the power stage 6, reducing the reliability of the switchgear 1 to below the reliability of known electromechanical contactors is avoided.

The converter 65 is configured to transform the second DC voltage VDD into a stabilized third DC voltage VCC. This voltage VCC is in this case delivered at output between a third electric power supply rail and ground 0V_ISO. This voltage VCC allows electric power to be supplied to the logic stage 7. For example, the voltage VCC has an amplitude equal to 3.3 V.

In this example, the converter 65 is a switch-mode converter of Buck step-down type, thereby making it possible to reduce heat dissipation and therefore to improve the efficiency of the converter 6. As a variant, it may be a linear converter of LDO low dropout regulator' type.

In this example, the converter 65 makes it possible to have a stabilized supply of electric power for the logic stage 7. Specifically, in practice, given the features of the converter 62, the voltage VDD generated by the latter is not stable enough to be provided directly to the logic stage 7. For example, the voltage VDD may have amplitude fluctuations that may go up to more or less 40%. However, such fluctuations are not detrimental to the excitation of the coil insofar as this excitation is performed by way of PWM regulation, as explained above. Thus, the use of the converter 62 is not detrimental to the correct operation of the relay 4.

The energy store 66 is capable of providing a backup supply of power to the logic stage 7 if the supply voltage for the switchgear 1 disappears, for example in the event of a failure of the source 3.

Thus, the store is dimensioned so as to allow the logic stage 7, and in particular the microcontroller 71, to provide pre-programmed emergency functions for a limited period of time, for example to send an alert message, as explained in the following text. The energy store 66, by contrast, is not intended to contain sufficient energy to provide for operation of the switchgear 1 in a normal operating regime.

For example, the store 66 is dimensioned so as to allow a radio message to be sent after a loss of external power supply, this radio message comprising four frames of a duration of 1.5 seconds. In this example, the store 66 allows at least 1 joule of energy to be stored.

Preferably, the energy store 66 is positioned upstream of the converter 65 within the stage 6.

This energy store 66 includes one or more capacitors, termed supercapacitors, that are connected between the second power supply rail VDD and ground 0V_ISO.

For example, the store 66 contains two 220 mF capacitors each connected to one another in series.

The store 66 advantageously contains a resistor, of at least 500Ω, connected in series with the capacitor(s), so as to limit the amount of energy consumed by the store 66 when the stage 6 is started up and also in order to limit the leakage current if one of the supercapacitors fails.

The supercapacitors are in this case electrolytic technology supercapacitors, thereby allowing their cost to be reduced. As they are not intended to provide functions linked to the switching of the relay 4, using electrolytic technology is not detrimental to the reliability of the power stage 6.

Figure 4:
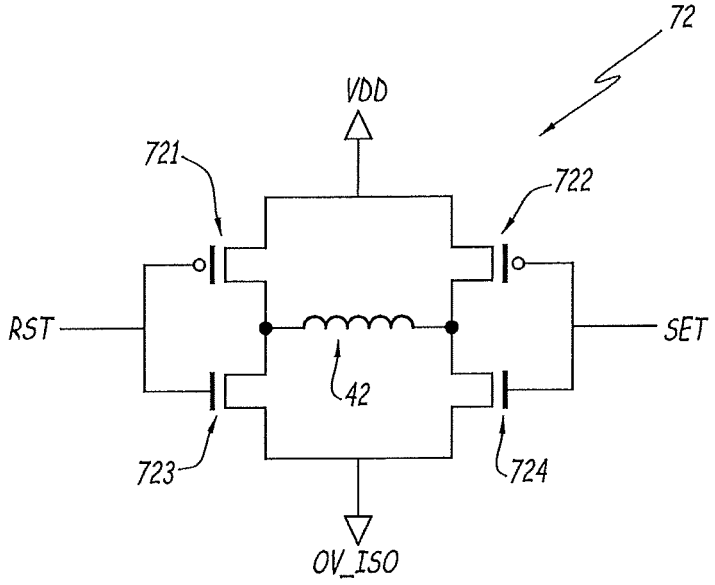
FIG. 4 is a schematic depiction of a circuit for tripping a bistable relay of the contactor of FIG. 1.

FIG. 4 schematically shows an example of the excitation circuit 72. The circuit 72 is connected to the terminals of the coil 42 so as to deliver an electric supply current when it receives one or more control signals SET, RST sent by the microcontroller 71 and, alternately, prevent the supply of power to the coil 42 in the absence of such a control signal. The circuit 72 is connected to the power supply rail VDD of the stage 6.

In this example, the excitation circuit 72 includes four transistors 721, 722, 723 and 724, connected so as to form an H-bridge. These transistors 721, 722, 723 and 724 are in this case MOSFET-technology field-effect transistors. As a variant, it is possible to use PNP and NPN bipolar transistors. It is also possible to use an integrated circuit that integrates such an H-bridge inside an individual component.

The transistors 721 and 722 are p-type transistors whose drain is connected to the opposite terminals of the coil 42 and whose source is connected to the power supply rail VDD. The transistors 723 and 724 are n-type transistors whose drain is connected to the opposite terminals of the coil 42 and whose source is connected to ground 0V_ISO. The gate of the transistors 721 and 723 is connected to a control output RST of the microcontroller 71, while the gate of the transistors 722, 724 is connected to a control output SET of the microcontroller 71.

As a variant, the excitation circuit 72 may be formed differently. For example, when the relay 4 includes two coils 42, then the circuit 72 is capable of exciting these two coils 42 simultaneously, for example by way of two transistors connected to the coils and driven by the control signals RST and SET.

However, the use of a single coil 42 is preferable, as this reduces the amount of current that is consumed.

Figure 5:
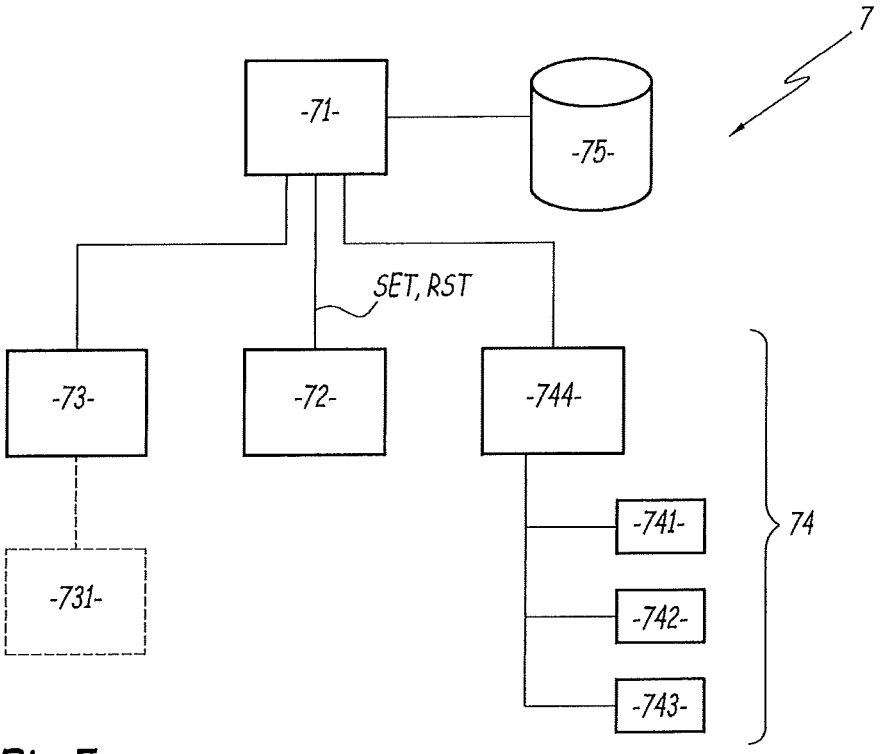
FIG. 5 is a simplified depiction of an overview of a circuit for controlling a logic stage of the contactor of FIG. 1.

As illustrated in FIG. 5, the logic stage 7 includes the microcontroller 71 and the excitation circuit 72.

The logic stage 7 in this case furthermore comprises a radio communication interface 73, which is capable of being connected to a radio antenna 731. The radio antenna 731 is in this case positioned outside the switchgear 1 while at the same time being connected to the interface 73 by way of a suitable connection, for example a coaxial cable and/or a radiofrequency connector, in this case an SMA connector.

The interface 73 is connected to the microcontroller 71 and is configured to allow the microcontroller 71 to send and to receive messages via radio in order to exchange data with the outside, for example with a remote computer server. The interface 73 thus allows the switchgear 1 to be managed remotely, for example so as to drive it or so as to monitor the operation thereof.

The radio interface 73 is preferably compatible with a low-power wireless network communication technology, also known under the name LPWAN for 'low-power wide-area network', for example so as to operate within a machine-to-machine communication network. By way of illustrative example, the interface 73 is compatible with LoRaWaN technology or, as a variant, with UNB 'ultra-narrow band' technology from Sigfox®.

The interface 73 is in this case connected to the power supply rail VCC and to ground 0V_ISO, thereby making it possible to supply it with energy. As explained previously, the galvanic isolation provided by the power stage 6 makes it possible to position the antenna 731 outside the housing of the switchgear 1 while at the same time limiting the electrical risk.

The logic stage 7 also comprises a measurement circuit 74 for measuring electrical variables and a computer memory 75.

The memory 75 is capable of storing data, and thus forms an information recording medium. For example, the memory 75 includes a non-volatile memory module, in this case a Flash memory module. The memory 75 is connected to the microcontroller 71, the latter being capable of reading and/or writing data to the memory 75.

The measurement circuit 74 is capable of measuring electrical variables such as an electric voltage and/or an electric current and of generating signals representative of the measured variables for the microcontroller 71.

To this end, the circuit 74 includes a probe 741 for measuring the voltage VDD, for the real-time measurement of the voltage VDD provided by the converter 62. This allows the microcontroller 71 in particular to implement the PWM regulation for the excitation of the coil 42.

For example, the probe 741 includes a voltage divider bridge integrated within the power stage 6, including a plurality of resistors connected between the power supply rail VDD and ground 0V_ISO. To facilitate reading of FIG. 2, this probe is not illustrated in FIG. 2.

As a variant, in contrast to what is illustrated, the probe 741 is independent of the circuit 74 and is, for example, connected directly to the microcontroller 71. The probe 741 therefore does not necessarily form part of the circuit 74, and may thus be omitted therefrom.

The circuit 74 is also able to measure the AC electric current and the AC electric voltage, delivered by the source 3 in order to supply power to the load 2, at the contacts 41. In the following text, this voltage and this current are named 'load voltage' and 'load current', respectively.

To this end, the circuit 74 includes a probe 742 for measuring the electric current instantaneously delivered by the source 3 and a probe 743 for measuring the AC supply voltage delivered by the source 3. This makes it possible to determine, at each instant, the amplitude values of the load voltage and of the load current, respectively.

In this example, the power stage 6 and the source 2 are both supplied with power by the source 3. The probes 742 and 743 are therefore positioned within the power stage 6. For the sake of simplicity, they are not illustrated in FIG. 2.

The circuit 74 also includes an analogue-to-digital converter 744, configured to transform the electrical variables measured by the probes 741, 742 and 743 into logic signals intended for the microcontroller 71. As explained above, as a variant, the probe 741 is not necessarily connected to this analogue-to-digital converter 744. Then, preferably, it is connected to the microcontroller 71 in order to use internal analogue-to-digital conversion means provided by the microcontroller 71. Specifically, it is not necessary to have such great accuracy with regard to the result of the measurements from the probe 741 as is necessary for the measurements coming from the probes 742 and 743.

For example, this converter 744 is incorporated into the microcontroller 71 within one and the same component.

Thus, the measurement of an electrical variable by the measurement circuit 74 in this case comprises acquiring a numerical value provided by the analogue-to-digital converter 744 and corresponding to the analogue electrical variable measured by one of the probes 742 or 743, this acquisition being able to be performed as a one off or repeatedly with a predefined sampling frequency.

The microcontroller 71 is in particular programmed to ensure operation of the switchgear 1 and in particular to automatically drive the relay 4, for example depending on orders received via the interface 73.

The microcontroller 71 is preferably a low-consumption microcontroller.

Figure 6:
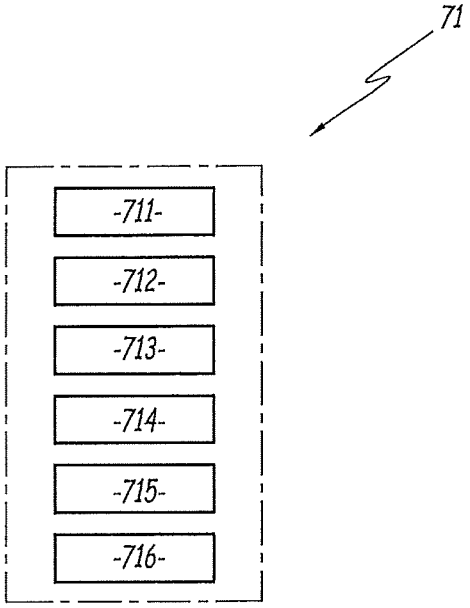
FIG. 6 is a simplified depiction of an overview of a microcontroller of the logic stage of FIG. 5.

As illustrated in FIG. 6, the microcontroller in this case includes a plurality of functional modules, for example each implemented by way of executable instructions stored within the memory 75 and capable of being executed by the microcontroller 71.

In particular, the microcontroller 71 in this case comprises:

- a PWM modulation control module 711 for exciting the coil 42;
- an energy supply management module 712;
- a module 713 for calculating the power factor of the load 2;
- modules 714 for detecting the zero crossing of the load current and voltage values measured by the probes 742 and 743;
- a module 715 for estimating the state of the relay 4;
- a module 716 for estimating the switching time of the relay 4; and
- a module, not illustrated, for managing the switching of the relay 4 depending on the nature of the load 2.

Other embodiments are possible, however. For example, the modules 715, 716 and the module for managing the switching of the electrical contacts 41 may be omitted and/or implemented independently of one another.

The microcontroller 71 is in particular programmed to implement the PWM regulation, in this case by virtue of the module 711, when excitation of the coil 42 of the relay 4 has to be tripped. This regulation is performed on the excitation voltage applied by the excitation circuit 72 across the terminals of the coil 42. This excitation voltage takes the form of a modulated voltage signal, formed of a sequence of pulses spaced apart in time and having a predefined amplitude level. In the absence of excitation, the applied voltage is zero.

For example, this regulation is performed depending on the voltage value VDD, as measured in this case by the probe 741. The duty cycle 'R' of the pulses of the modulated signal is calculated using the following formula:

$$R = \frac{\text{Vbob_min}}{Vsense},$$

where 'Vbob_min' denotes the minimum voltage required to achieve switching of the relay 4 and 'Vsense' denotes the measured voltage value VDD.

Thus, the duty cycle R increases when the voltage VDD across the terminals of the set of capacitors 64 decreases, and decreases when the voltage VDD increases. This makes it possible to keep the amplitude of the pulses of the electric supply current at a sufficient level, in spite of possible fluctuations in the voltage VDD.

The calculation of the duty cycle R is repeated periodically over time by the microcontroller 71.

The measurement and/or the sampling of the value Vsense is preferably performed at a low frequency, for example lower than or equal to 5 kHz or, preferably, lower than or equal to 2 kHz. In this case, the frequency is chosen to be equal to 2 kHz.

In the present case, given the values of the switching time of the relay 4 and of the time constant of the coil 42, the frequency of 2 kHz makes it possible to perform a measurement that is repeated over time, without having to call upon this function of the microcontroller 71 excessively often, thereby making it possible to reduce the energy consumption thereof even further.

The microcontroller 71 is then programmed to generate the corresponding control signals RST, SET for the circuit 72.

When the switching of the relay 4 takes effect, the excitation is stopped. For example, it is stopped after a predetermined duration. The PWM regulation is interrupted and the excitation voltage is no longer applied by the excitation circuit 72. To this end, the microcontroller 71 generates corresponding control signals RST, SET for the circuit 72.

Optionally, when the power stage 6 includes the energy store 66, then the microcontroller 71 is furthermore programmed to automatically manage a situation of loss of the supply of electric power to the power stage 6, in particular by:

- emitting a predefined alert signal by way of the communication interface 73, and
- interrupting those functions of the microcontroller 71 that are not necessary for making the radio interface 73 work, such as the PWM regulation and the controlling of the excitation circuit 72, the analogue-to-digital converter 744 and the function of receiving data on the radio interface 73.

For example, the predefined alert signal is recorded in the memory 75, as is its destination. By way of illustration, the store 66 in this case makes it possible to send 3 to 4 frames of a predefined alert message, by way of the antenna 731. The loss of power supply is detected for example by way of the measurement probes 741 and 742.

Independently of this aspect, the microcontroller 71 is furthermore advantageously programmed, in this case by virtue of the module 712, to optimize energy consumption, in particular by avoiding exciting the coil 42 when an energy-consuming operation is being performed, for example when the communication interface 73 is sending a radio message by way of the antenna 731. The microcontroller 71 is in this case also programmed to avoid exciting the coil 42 as long as the capacitors of the second set 64 are not sufficiently recharged, their state of charge being estimated by measuring the voltage VDD by way of the probe 741.

For example, when a switching order is received by the switchgear 1, for example on the communication interface 73, the microcontroller 71 temporarily prevents the implementation of the PWM regulation and the activation of the excitation circuit 72 as long as said operation has not ended. Nevertheless, this prevention remains sufficiently short so as not to impair the reliability of the switching of the relay 4. It may also be omitted.

Advantageously, the microcontroller 71 is programmed, in this case by virtue of the module 713, to calculate the power factor of the load 2 when the latter is connected to the switchgear 1. This power factor, denoted cos φ, is for example calculated from the phase offset φ between the load current and voltage that are measured by the measurement probes, 743 and 742, respectively. The power factor is in this case calculated automatically by way of a logic calculating unit of the microcontroller 71.

Furthermore, the microcontroller 71 is in this case programmed, by virtue of the module 715, to automatically detect the zero crossing of the load current and of the load voltage. This calculation is performed for example by way of a logic calculating unit of the microcontroller 71.

Advantageously, the microcontroller 71 is programmed, in this case by virtue of the module 715, to estimate the state of the electrical contacts 41 of the relay 4, that is to say to determine whether, at a given instant, the electrical contacts 41 are in the open state or in the closed state, or else to determine an abnormal state.

This determination is performed in this case by way of a measurement of the current, termed load current, flowing through the electrical contacts 41 in order to supply power to the load 2 when the latter is connected to the switchgear 1, for example using the measurement probe 742.

It is thus not necessary to use a dedicated specific sensor within the relay 4 or the switchgear 1 to ascertain the state of the relay 4. Such a specific sensor is not desirable on account of its bulk, which therefore complicates the integration of the components of the switchgear 1. This is all the more useful given that, in practice, the relay 4 is generally formed of a one-part component encapsulated in a housing and of which the mobile parts of the contacts are not readily accessible from the outside.

This determination function in this case makes it possible, when the switchgear 1 is controlled remotely by way of the communication interface 73, to verify the correct execution of an order to switch the relay 4 or, by contrast, to detect a failure of the relay 4.

An exemplary method of operation of this detection of the state of the contacts is described with reference to the flow chart of FIG. 7. The microcontroller 71 is in particular programmed, by virtue of the module 715, to implement the steps of this method.

This method is for example implemented automatically by the microcontroller 71 after having ordered the switching of the relay 4 following the reception of a control order, preferably immediately after.

First of all, in a step 1000, the microcontroller 71 acquires, or determines, the prior switching order received previously by the switchgear 1, for example the last received prior switching order. This order may adopt a value 'ON' if its aim was to command the closure of the electrical contacts 41, or, alternatively, a value 'OFF' if its aim was to command the opening of the electrical contacts 41.

For example, each order received by the communication interface 73 is recorded in the memory 75. The acquisition therefore includes the microcontroller 71 looking up and reading the corresponding information in the memory 75.

Next, in a step 1002, the value of the current that is flowing is measured in order to determine a flow state of the electric current to the electrical load 2 by way of the contacts 41. This measurement is in this case performed by virtue of the measurement probe 742 of the measurement circuit 74. For example, the microcontroller 71 acquires a numerical value from the analogue-to-digital converter 744, corresponding to a sampled value of the signal measured by the probe 742. The state is the on state if a non-zero current value is measured, and, by contrast, the state is the off state if the measured value is zero.

Next, in a step 1004, the state of the relay 4 is estimated on the basis of predefined rules and depending on the determined current flow state and the acquired previous order. These rules define a set of scenarios, each parameterized by a preceding order value and by a measured current flow state, on state or off state. These rules are for example stored in the memory 75.

Thus, a scenario is selected depending on the acquired order and depending on the conduction state derived from the measured value.

If the scenario corresponds to a normal situation, then the estimated state of the contacts 41 is for example recorded by the microcontroller 71 and/or transmitted by the communication interface 73 to the entity that emitted the switching order.

By contrast, if the scenario corresponds to an anomaly situation, then the microcontroller 71 executes a predefined action, for example an alarm. As a variant, the microcontroller 71 may wait for a predetermined period before sending an alarm.

For example, if the anomaly is not definitely able to be ascribed to a failure of the relay 4, but may plausibly depend on causes external to the relay 4, such as a loss of the supply of power to the source 3, or because the load 2 is not consuming current at this precise instant, then the alarm is not emitted and the microcontroller 71 waits for a predefined time. The method may then be reiterated at this moment in order to determine the state of the relay 4. If the anomaly is repeated on this occasion, then the microcontroller 71 sends an alarm this time.

These scenarios are summarized in the table below:

| | Absence of current | Presence of a current |
|---|---|---|
| Order ON | Anomaly 1 | Closed |
| Order OFF | Open | Anomaly 2 |

For example, following an opening order 'OFF', the contacts 41 have to be in the open state, and therefore no current should be able to flow therein. If the measured current value corresponds to such an absence of current, then the contacts 41 are considered to be in the open state. A presence of a current following such an order indicates an anomaly. By contrast, following a closure order 'ON', the contacts 41 have to be closed to allow a current to flow, and it is then the absence of a current that indicates an anomaly.

In this table, the 'anomaly 1' corresponds to a first anomaly in which the current is absent when it is supposed to be flowing. This anomaly may be caused either by unsuccessful switching of the relay 4 or by a failure of the contacts 41 to conduct, for example due to soiling or to premature wear, or by a failure of the load 2 independently of the state of the relay 4.

The 'anomaly 2' corresponds to a second anomaly in which a current is flowing when it is not supposed to be. For example, the contacts 41 have accidentally been soldered together, or the relay 4 has not switched, or the mobile parts of the contacts 41 have impermissibly moved, for example following a mechanical impact.

Advantageously, the microcontroller 71 is programmed, in this case by virtue of the module 716, to estimate the switching time of the relay 4. This switching time, denoted Δt in the following text, is defined as the duration between the tripping of the excitation, for example the instant when the circuit 72 beings to supply power to the coil 42, and the instant when the movement of the contacts 41 takes effect. This allows the microcontroller 71 to have reliable and up-to-date knowledge of this value. Specifically, the switching time of the relay 4 may change over time following wear to the switchgear 1.

An exemplary method of operation of the detection of the contacts is described with reference to the flow chart of FIG. 8, the steps of which are in this case implemented by the microcontroller 71 by virtue of the module 716.

The following steps are then implemented during operation of the switchgear 1, for example upon each switching of the relay 4. Another periodicity may be chosen as a variant, however.

At the start of the method, a switching time value Δt is known and for example recorded in the memory 75.

This may be a switching time value Δt that is estimated by way of a previous iteration of the method. During the initial uses of the method, it may be the switching time Δt that is initially measured in the factory when the switchgear 1 is constructed, for example by way of a dedicated test bench, thereby making it possible to achieve a precise measurement. The switching time value Δt thus measured is recorded, for example within the memory 75.

Firstly, in a step 1010, switching of the relay 4 is commanded. For example, the microcontroller 71 commands the excitation of the coil 42 following the reception of a switching order.

Next, in a step 1012, the time Δt_m necessary for switching the relay 4 is measured. For example, the microcontroller 71 counts the time that lapses starting from the moment when, in step 1010, the excitation of the coil 42 is commanded, until the effective switching of the relay 4. This switching is for example detected by measuring the evolution of the electric current and/or of the load voltage, for example by way of the measurement probes 742 and/or 743 of the circuit 74. The time is advantageously counted by way of a digital clock integrated into the microcontroller 71. The time thus counted may advantageously be corrected by a predetermined factor so as to take account of the calculating time required by the microprocessor 71 to process the signals coming from the circuit 74.

Next, in a step 1014, the time Δt_m thus measured is compared with the known switching time value Δt. For example, the microcontroller 71 reads the value of the known switching time Δt in the memory 75 and compares it with the measured value of the period at the end of step 1012.

If the measured time Δt_m is equal to the known switching time, for example to within a predefined margin of error, then, in a step 1016, the switching time Δt is considered not to have changed. The known switching time value Δt remains unchanged.

By contrast, if the measured time Δt_m is different from the known switching time, for example to within a predefined margin of error, then the switching time is considered to have changed since the last switching of the relay 4.

In this case, in a step 1018, the known switching time value Δt is updated, taking account of the measured time Δt_m. For example, the known switching time value Δt is replaced by the measured time value Δt_m.

As a variant, a new switching time value Δt is calculated by taking the mean of the measured time value Δt_m and one or more of the old switching time values successively updated in previous iterations of the method.

This updating is performed by the microcontroller 71, for example by writing a new value to the memory 75, this value now being considered to be the known switching time value.

In this example, the switching time Δt is considered to be the same for the opening and the closure of the contacts 41. However, as a variant, the switching time may be different upon opening and upon closure. The method thus described may then be implemented analogously to estimate each of these two separate switching times.

Advantageously, the microcontroller 71 is furthermore programmed, in this case by virtue of the switching management module, to optimize the switching of the electrical contacts 41 of the relay 4 depending on the nature of the electrical load 2 connected to the switchgear 1. More precisely, the microcontroller 71 is programmed, when a switching order is received, to synchronize the switching of the relay 4 with favourable switching conditions that are specifically chosen depending on the nature of the load 2, such as a zero crossing of the current and/or of the load voltage.

In practice, the switchgear 1 is intended to be used with electrical loads of different natures, and it is not possible to know in advance, when manufacturing the switchgear 1, what type of load will be used. Now, each type of load, depending on whether it is resistive, capacitive or inductive, entails a particular risk during switching of the relay 4. Repeated switching operations in unfavourable conditions lead to damage to the electrical contacts 41, thereby reducing the lifetime of the switchgear 1.

For example, with a load of capacitive nature, such as a fluorescent-tube or light-emitting diode lighting assembly, a high current peak is often obtained when the relay is closed, entailing a risk of accidental soldering of the contacts. By contrast, with a load of inductive nature, such as an electric motor, an electric arc often occurs between the electrical contacts upon opening, thereby compromising the effectiveness of the switchgear 1.

By way of illustrative example, for an electrical load 2 comprising an assembly of fifty fluorescent lighting tubes each with a nominal power of 35 W, having a total apparent power of 2 kVA, a total effective current of 9 A, a peak steady-state current of 13 A, a line inductance of 150 pH and a total capacitance of 175 μF, then the maximum peak current when the load 2 is powered up at the moment of closure of the contacts 41 may reach a value of 350 A, i.e. more than twenty-seven times the value of the peak current in steady-state operation.

The method for optimizing the switching of the relay 4 therefore aims to rectify these drawbacks, for the purpose of avoiding premature wear of the electrical contacts 41.

An exemplary method of operation of this method for optimizing the switching is described with reference to the flow chart of FIG. 9 and with the aid of the timing diagram of FIG. 10.

Firstly, in a step 1030, the type of load 2 is identified automatically. For example, the microcontroller 71 automatically determines the phase offset φ between the voltage and the current at the terminals of the load 2, and the power factor cos φ associated with the load 2, on the basis of measurements of the current and of the electric voltage at the terminals of the load 2. This determination is performed in this case by way of the module 713 and of the measurement circuit 74.

The type of load 2 is identified from among a predefined list depending on the power factor cos φ and on the phase offset. In this case, the load 2 may be one of the following types: resistive, capacitive or inductive.

For example, the load 2 is resistive if the power factor cos φ is equal to 1. The load 2 is capacitive if the power factor cos φ is lower than 1 and the phase offset is positive, and is inductive if the power factor cos φ is lower than 1 and the phase offset is negative.

As a variant, the identification may be based on a power factor value that is already known, for example a value previously calculated and stored in the memory 75 in a previous iteration of the method, or else a default value set in the factory, in particular upon the initial commissioning of the switchgear 1.

Next, in a step 1032, a strategy for synchronizing the switching is chosen automatically depending on the identified load type. This choice is made depending on predefined rules that are for example recorded in the memory 75.

For example, the choice of a synchronization strategy includes selecting relevant electrical variables able to be measured at the power supply terminals of the load 2, therefore in this case at the contacts 41, the temporal evolution of which has to be monitored. The switching is synchronized depending on these electrical variables.

For example, these electrical variables are chosen from among the set formed by the load current, the load voltage, the instantaneous power at the power supply terminals of the load 2, or even the harmonics of this voltage and/or of this current and/or of this power.

The choice of a synchronization strategy also comprises determining a switching threshold for each chosen relevant electrical variable and for each switching direction, i.e. opening or closure. This switching threshold corresponds to the value of this variable for which the switching of the relay 4 has to be tripped so as to command switching in accordance with the strategy. In practice, in this case, it is desirable to command the switching such that it takes place during the zero crossing of the relevant variable.

For example, for a resistive load, the relevant electrical variables are the load current and voltage. To promote optimum switching, the switching strategy consists in waiting for the zero crossing of the voltage to close the contacts 41 and in waiting for the zero crossing of the current to open the contacts 41.

According to another example, for a capacitive load, the relevant electrical variable is the load voltage. To promote optimum switching, the switching strategy consists in waiting for the zero crossing of the voltage to open or to close the contacts 41.

According to yet another example, for an inductive load, the relevant electrical variable is the load current. To promote optimum switching, the switching strategy consists in waiting for the zero crossing of the current to open or to close the contacts 41.

Thus, in a first stage, the switching threshold may be chosen to be equal to zero.

Advantageously, the switching thresholds may be different, so as to take account of the switching time Δt of the relay 4. In practice, so that the switching takes place upon the zero crossing of an electrical variable, the switching has to be commanded in advance with respect to the instant when this zero crossing takes place, this advance being equal to the switching time Δt.

For example, the switching threshold then corresponds to the theoretical value adopted by this relevant electrical variable at the instant anticipating the zero crossing with a duration equal to the switching time Δt. This theoretical value may be predicted, in this case automatically by the microcontroller 71, for example by interpolation or with knowledge of the form of the periodic signal adopted by the relevant electrical variable as a function of time.

As a variant, when the temporal evolution of the electrical variable is known, for example in the case of a periodic signal with a known period T, then the switching threshold may also be chosen to be equal to zero. Next, the switching is tripped at the end of a duration equal to the difference between the period T and the switching time Δt.

In practice, however, a default strategy may be implemented if the load type is not able to be identified with certainty. In this case, by default, the switching is preferably performed upon the zero crossing of the voltage. The relevant electrical variable is therefore the voltage.

Next, in a step 1034, the microcontroller 71 waits to receive a switching order. Next, as soon as a switching order is received, for example received on the communication interface 73, then, in a step 1036, the chosen driving strategy is implemented so as to identify a switching condition. This implementation includes measuring one or more electrical variables so as to detect a switching condition corresponding to the chosen synchronization strategy.

For example, each chosen electrical variable is measured, in this case by virtue of the measurement circuit 74. Each value thus measured is compared automatically, by the microcontroller 71, with the switching threshold chosen in step 1032 for the corresponding order.

As soon as a switching condition corresponding to this switching strategy is identified, then, in a step 1038, the switching of the relay 4 is tripped by the microcontroller 71. The tripping of the switching of the relay is prevented, at least temporarily, as long as a switching condition corresponding to this switching strategy is not identified.

For example, the microcontroller 71 trips the switching by driving the excitation circuit 72 only when it has detected that the measured value has reached the switching threshold. This tripping may, depending on the chosen switching strategy, take place immediately or after expiry of a predefined period duration, as explained above.

However, if no switching condition has been detected upon expiry of a predefined safety period, then the switching of the relay 4 is triggered automatically at the end of this safety period. Specifically, it is essential that the switchgear 1 executes the switching order that has been transmitted thereto, even if the switching does not then take place at an optimum instant.

In step 1040, the switching of the relay 4 is achieved and takes effect, following the switching command of step 1038.

In this example, the method in this case returns to step 1034, waiting for a new switching order. For example, the method is reiterated in a loop until the switchgear 1 is extinguished.

However, if the switching of the relay 4 is not effective, then the method is interrupted and step 1034 is applied again.

Optionally, steps 1000 to 1004 of the method of FIG. 6 are advantageously implemented following step 1038, in order to estimate the state of the contacts 41, in particular in order to verify whether the switching of the relay 4 has indeed taken place in accordance with the command that was sent.

Figure 9:
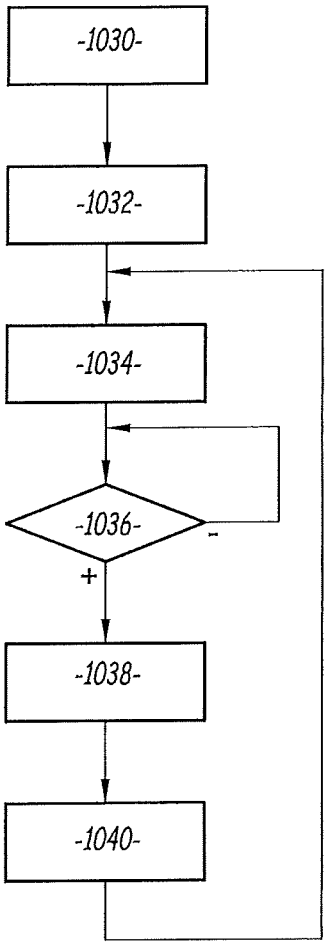
FIG. 9 is a flow chart of a detection method for managing the switching of the electrical contacts of the contactor of FIG. 1, implemented using the logic stage of FIG. 5.
Figure 10:
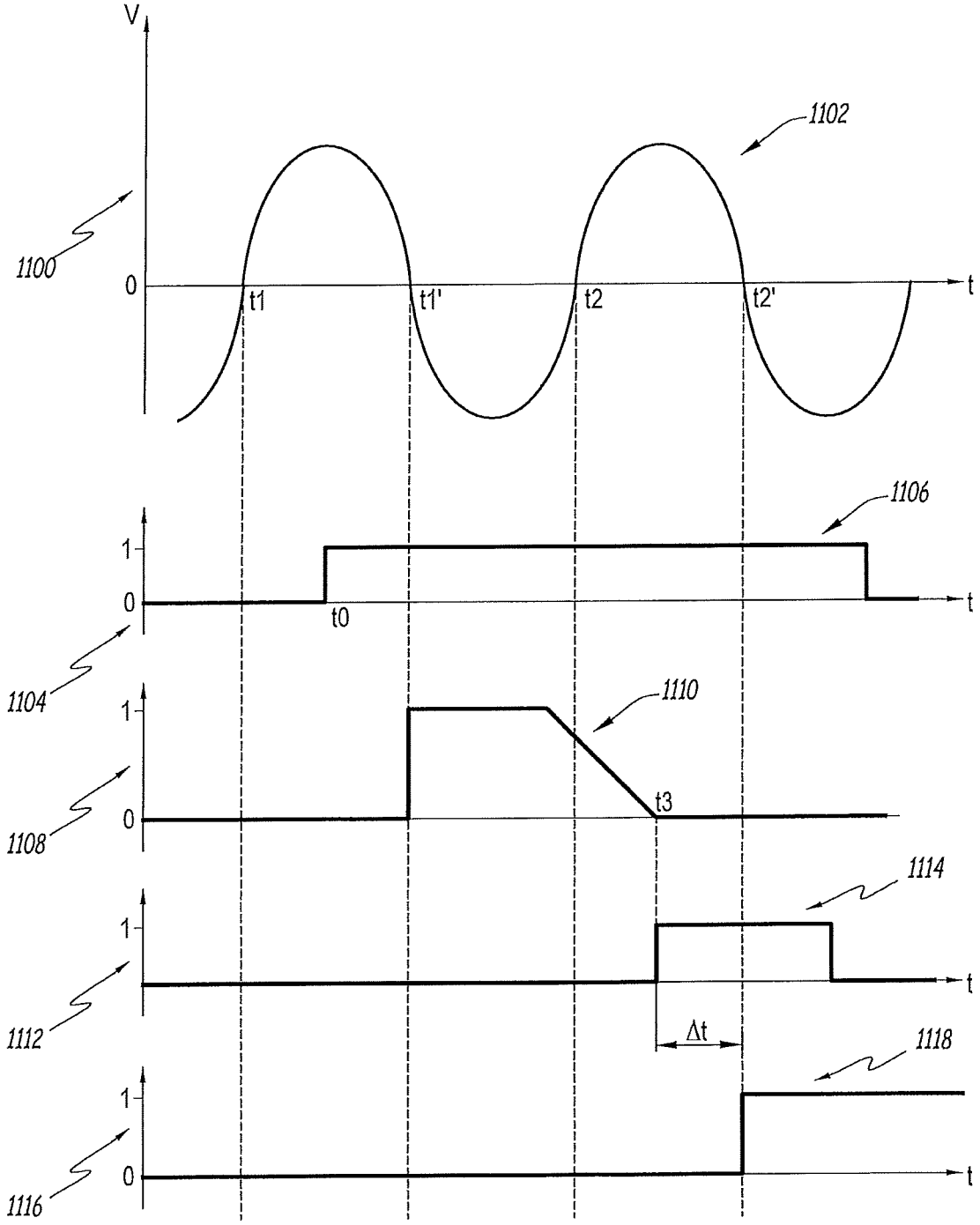
FIG. 10 is a simplified timing diagram illustrating the temporal evolution of command signals for switching the electrical contacts of the contactor of FIG. 1, when the method of FIG. 9 is implemented.

FIG. 10 illustrates an exemplary application of the method for optimizing the switching of FIG. 9 when a load 2 is connected. The load 2 is in this case known, and the switching strategy for closing the contacts consists in waiting for the zero crossing of the voltage on a falling edge.

The graph 1100 illustrates the evolution, as a function of time t, of the amplitude V of the electric voltage 1102 used to supply the load 2. For the sake of simplicity, in this example, the voltage 1102 is periodic with a period T and has a sinusoidal form.

't1' and 't2' are used to denote the instants at which the voltage 1102 crosses zero on a rising edge, and 't1'' and 't2'' are used to denote the instants at which the voltage 1102 crosses zero on a falling edge.

The graph 1104 illustrates the evolution, as a function of time t, of a curve 1106 representing the state of reception of an order to switch the relay 4 by the device 1. On the ordinate axis, the value '0' indicates an absence of a switching order, and the value '1' indicates that a switching order is received.

The graph 1108 illustrates the evolution, as a function of time t, of a curve 1110 representing the state of activation of a timer that times a predefined duration starting from the instant of the zero crossing of the voltage 1102 following the instant t0. On the ordinate axis, the value '0' indicates an inactive state of the timer and the value '1' indicates the activation of the timer.

The graph 1112 illustrates the evolution, as a function of time t, of a curve 1114 representing the state of excitation of the coil 42. On the ordinate axis, the value '1' indicates that the excitation circuit 72 is activated and is supplying power to the coil 42, and the value '0' indicates the absence of a supply of power to the coil 42.

Lastly, the graph 1116 illustrates the evolution, as a function of time t, of a signal 1118 representing the state of the contacts 41 of the relay 4. On the ordinate axis, the value '0' indicates that the contacts 41 are in the open state and the value '1' indicates that the contacts 41 are in the closed state.

Initially, no switching order is received. The method is at step 1030 described above. Next, at an instant denoted 't0', in this case between the instants 't1' and t1'', a switching order is received by the switchgear 1. Step 1036 is then implemented. When a first zero crossing of the voltage 1102 on a falling edge is detected at the instant t1', the timer is started and times a predefined duration, until an instant t3. This duration is in this case equal to the difference between the period T and the switching time Δt upon closure. This makes it possible to anticipate the following zero crossing on a falling edge, at the instant t2', by taking account of the switching time Δt. Thus, at the instant t3, the coil 42 is commanded by the excitation circuit 72 for the purpose of closing the contacts 41, as illustrated by the curve 1114. Next, after a period equal to the switching time Δt, the closure of the contacts 41 takes effect, as illustrated by the curve 1118.

Figure 7:
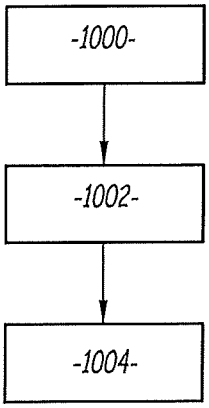
FIG. 7 is a flow chart of a method for detecting the state of electrical contacts of the contactor of FIG. 1, implemented using the logic stage of FIG. 5.
Figure 8:
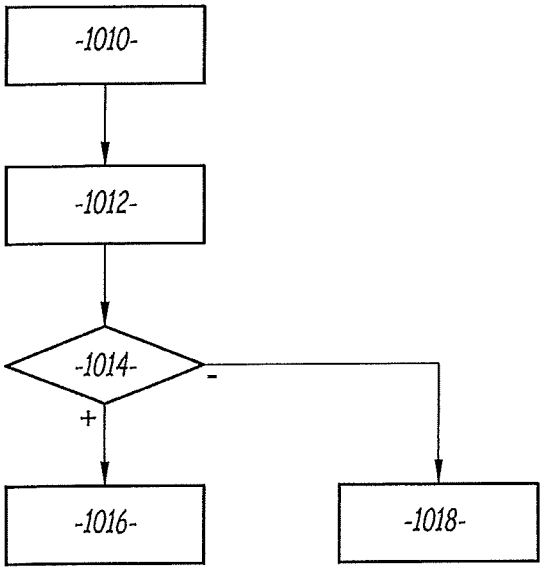
FIG. 8 is a flow chart of a method for learning a switching time of the electrical contacts of the contactor of FIG. 1, implemented using the logic stage of FIG. 5.

The methods of FIGS. 7, 8 and 9 may be implemented independently of the embodiments of the power stage 6.

The embodiments and the variants contemplated above may be combined with one another so as to create new embodiments.

The invention claimed is:

1. A controllable electric current switchgear, said switchgear being capable of being connected between an electrical load and an electric power source, so as to selectively allow or prevent the supply of electric power to the electrical load by the power source, the switchgear comprising:

a bistable relay comprising separable electrical contacts and an excitation coil for commanding switching of the electrical contacts, said electrical contacts being capable of connecting the electrical load to the power source, the relay being capable of switching the electrical contacts between open and closed states when the coil receives an amount of energy that is higher than a predefined excitation energy threshold with an electric power that is higher than a predefined power threshold;

a control circuit comprising a power stage and a logic stage, the power stage being capable of providing a supply of electric power to the logic stage, the logic stage comprising an excitation circuit for supplying power to the coil and a programmable microcontroller that drives the excitation circuit so as to trip switching of the relay, wherein the power stage comprises a power converter, a first set of capacitors connected at an input of the power converter and a second set of capacitors connected at an output of the power converter, wherein nominal power of the power converter is strictly lower than the power threshold of the coil, and wherein the first and second sets of capacitors are capable of storing an amount of energy that is higher than or equal to 50% of the excitation energy threshold required to switch the relay.

2. The switchgear according to claim 1, wherein the power converter is a flyback converter comprising a voltage transformer, the first set of capacitors being connected to a primary winding of the transformer, the second set of capacitors being connected to a secondary winding of the transformer.

3. The switchgear according to claim 1, wherein the second set of capacitors is capable of storing at least 50% of the excitation energy necessary for switching the relay.

4. The switchgear according to claim 1, wherein the capacitors of the first set are made of ceramic and in that the capacitors of the second set are made of tantalum.

5. The switchgear according to claim 1, wherein the power stage comprises an additional power converter capable of supplying a stabilized DC electric voltage for supplying electric power to at least part of the logic stage.

6. The switchgear according to claim 1, wherein the microcontroller is programmed to drive the excitation circuit using a pulse width modulation technique, the excitation circuit being capable of supplying the coil with a modulated supply voltage.

7. The switchgear according to claim 1, wherein the microcontroller is programmed to implement, after having ordered the switching of the relay following reception of a control order, steps of:

determining a previously received prior switching order, determining a flow state of electric current to the electrical load by way of the electrical contacts of the relay, said state being able to indicate the absence or the presence of a current, estimating a state of the relay on the basis of predefined rules and depending on the determined current flow state and on the prior switching order.

8. The switchgear according to claim 1, wherein the microcontroller is programmed to implement, after having ordered the switching of the relay following reception of a control order, steps of:

measuring time ($\Delta t_m$) necessary for the switching of the relay;

comparing the measured time ($\Delta t_m$) with a known switching time value ($\Delta t$) of the relay, in order to determine whether the measured time ($\Delta t_m$) is different from the known switching time value ($\Delta t$);

updating the known switching time value ($\Delta t$), on the basis of a value of the measured time ($\Delta t_m$), only if the measured time ($\Delta t_m$) is determined as being different from the known switching time value ($\Delta t$).

9. The switchgear according to claim 1, wherein the microcontroller is programmed to implement steps of:

identifying a type of the electrical load;

choosing a strategy for synchronizing the switching depending on the identified load type;

following reception of a switching order, implementing the chosen synchronization strategy, said implementation including measuring at least one electrical variable between power supply terminals of the electrical load in order to detect a switching condition corresponding to the chosen synchronization strategy;

tripping the switching of the relay when a switching condition corresponding to this said switching strategy is identified on the basis of the at least one measured electrical variable, the tripping of the switching of the relay being prevented, at least temporarily, as long as a switching condition corresponding to this said switching strategy is not identified.

10. The switchgear according to claim 1, wherein the logic stage comprises a radio communication interface capable of being connected to a radio antenna, said radio antenna being positioned outside a housing of the switchgear and connected to the interface.

11. The electrical assembly comprising an electrical load, an electric power source capable of delivering an electric supply voltage, and electric current switchgear, the switchgear being connected between the electrical load and the electric power source and comprising a controllable relay whose separable electrical contacts selectively connect the power supply terminals of the electrical load to the source or, alternately, electrically isolate them from the source, the electrical assembly wherein the switchgear is in accordance with claim 1.

* * * * *